United States Patent [19]

Zepp

[11] Patent Number: 4,651,123

[45] Date of Patent: Mar. 17, 1987

[54] LINEAR POTENTIOMETER

[75] Inventor: Lawrence P. Zepp, Toledo, Ohio

[73] Assignee: International Hydraulic Systems, Inc, Southgate, Mich.

[21] Appl. No.: 638,226

[22] Filed: Aug. 6, 1984

[51] Int. Cl.[4] ..... H01C 10/38

[52] U.S. Cl. ..... 338/176; 338/154; 338/173; 338/99

[58] Field of Search ..... 338/176, 154, 173, 201, 338/168, 167, 96, 99

[56] References Cited

U.S. PATENT DOCUMENTS

| | | | |
|---|---|---|---|
| 2,862,088 | 11/1958 | Mairs | 338/154 |
| 2,862,089 | 11/1958 | Mairs | 338/154 |
| 3,070,768 | 12/1962 | Mairs | 338/154 |
| 3,516,041 | 6/1970 | Estlick | 338/154 |
| 3,624,584 | 2/1970 | Ohno | 338/154 X |
| 3,626,350 | 12/1971 | Suzuki | 338/69 |
| 3,673,539 | 6/1972 | Healy et al. | 338/154 |
| 3,764,953 | 10/1973 | Lehnert | 338/154 |
| 4,333,068 | 6/1982 | Kishel | 338/158 |

*Primary Examiner*—Clarence L. Albritton
*Assistant Examiner*—M. M. Lateef
*Attorney, Agent, or Firm*—Cullen, Sloman, Cantor, Grauer, Scott, & Rutherford

[57] ABSTRACT

A linear potentiometer with a sandwich type construction. A pair of conductive strips are carried on a pair of non-conductive flexible plastic substrates which are affixed to a spacer to form a sealed unit. Each substrate includes a pair of tabs which cooperate with the tabs on the other substrate to define a pair of terminal receiving slots for connecting the potentiometer in an electrical circuit.

15 Claims, 6 Drawing Figures

LINEAR POTENTIOMETER

BACKGROUND OF THE INVENTION

This invention relates to electrical resistance devices, and more specifically to linear potentiometers.

Linear potentiometers, of course, are well known and can be found in a number of different forms. It is my intention to provide an improved linear potentiometer which is low-cost, rugged, compact, easily installed and sealed from the surrounding environment.

BRIEF SUMMARY OF THE INVENTION

This invention relates to linear potentiometers. In a preferred embodiment, the linear potentiometer includes a first non-conductive flexible plastic substrate with first and second tabs and a second non-conductive flexible plastic substrate with third and fourth tabs. A first conductive strip is carried by the first substrate and runs from the first tab along a portion of the first substrate. Similarly, a second conductive strip is carried by the second substrate and runs from the fourth tab along a portion of the second substrate. The substrates are affixed to the opposite sides of a non-conductive plastic spacer which includes a slot and are disposed so that the strips overlay the slot in facing relationship to each other and the tabs extend past one end of the spacer to define a pair of terminal receiving slots.

It is a principal object of my invention to provide an improved linear potentionmeter.

The above and other objects, features and advantages of my invention will become apparent upon consideration of the detailed description together with the appended drawing.

DETAILED DESCRIPTION OF THE PREFERRED EMBODIMENT

Figure 2:
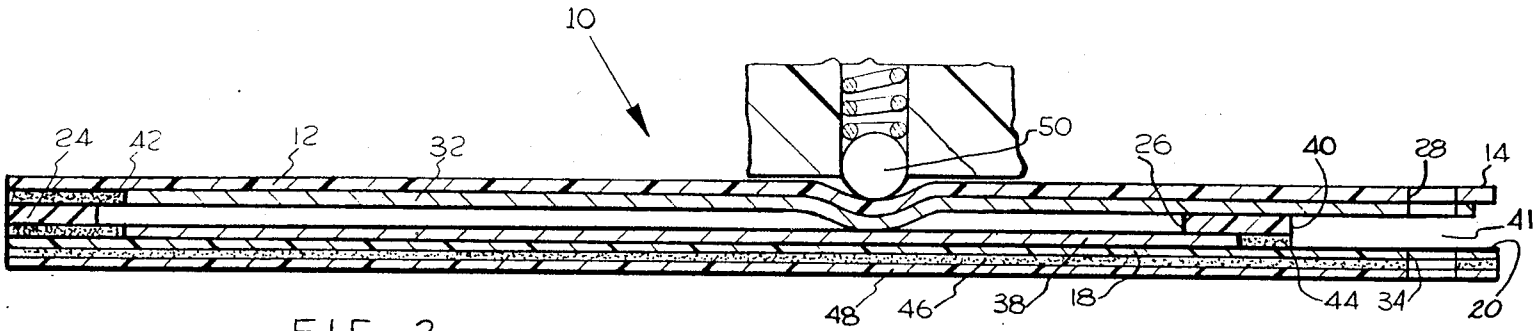
FIG. 2 is an enlarged cross-section taken along line 2—2 in FIG. 1.
Figure 3:
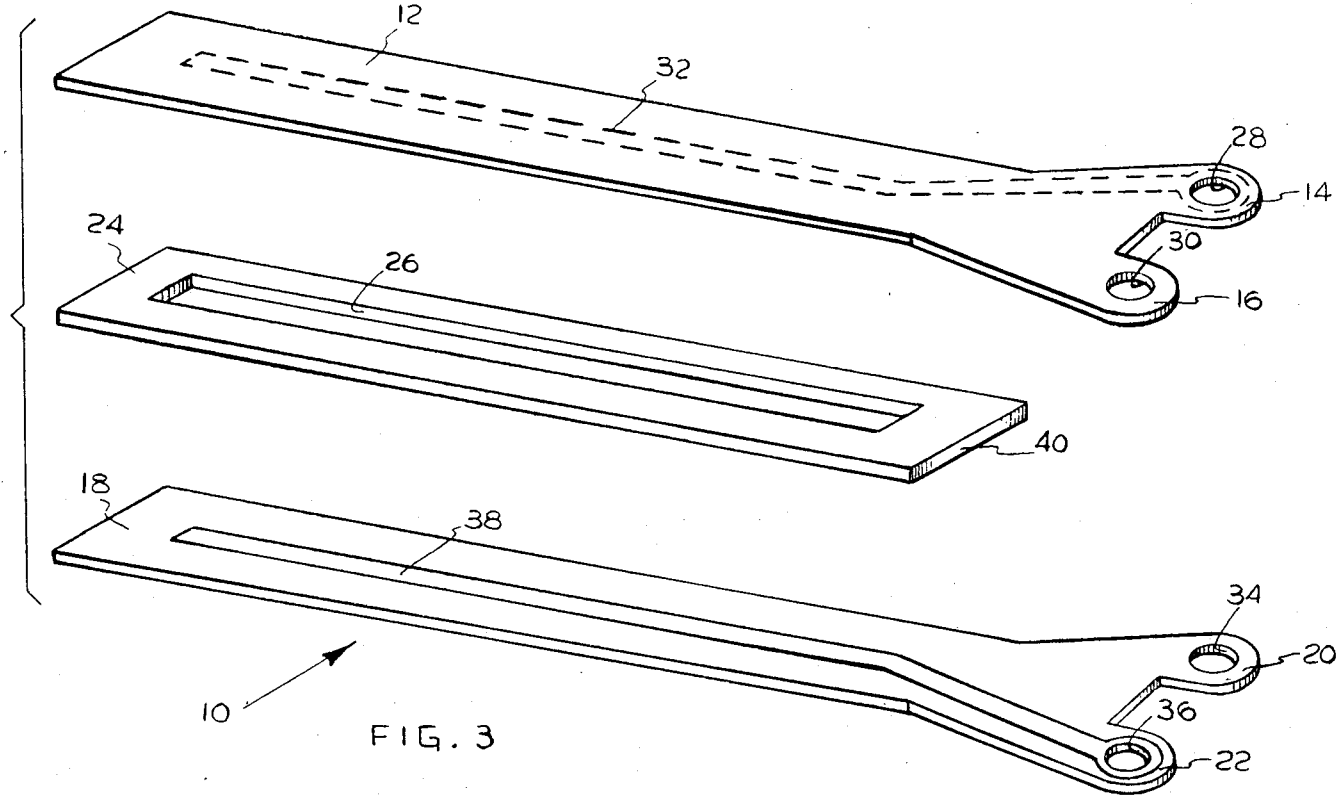
FIG. 3 is an exploded perspective view of the linear potentiometer shown in FIG. 1.

Referring to the drawing, reference numeral 10 denotes a linear potentiometer having an elongated generally rectangular shape. Potentiometer 10 has a sandwich construction, best seen in FIGS. 2 and 3, and includes a non-conductive flexible plastic substrate 12 with a pair of integral tabs 14 and 16, a non-conductive flexible plastic substrate 18 with a pair of integral tabs 20 and 22, and a non-conductive plastic spacer 24 with a slot 26 located between substrates 12 and 18.

Substrate 12 includes a pair of openings 28 and 30 in tabs 14 and 16, respectively. Also, substrate 12 carries a conductive strip 32 which surrounds opening 28 and then runs along the center of one side of substrate 12.

Strip 32 preferably is a conductive ink which is applied to one surface of substrate 12 by a silk screen process.

Similarly, substrate 18 includes a pair of openings 34 and 36 in tabs 20 and 22, respectively. Also, substrate 18 carries on one surface a conductive strip 38 which surrounds opening 36 and generally runs along the center of one side of substrate 18, as shown.

In assembling potentiometer 10 substrates 12 and 18 are disposed on opposite sides of spacer 24 so that tabs 14, 16, 20, and 22 extend past one end 40 of spacer 24 to define a pair of terminal receiving slots 41 and 43 and strips 32 and 38 overlie slot 26 in facing relationship to each other. Preferably, substrate 12 is affixed to spacer 24 by a layer of adhesive 42 and substrate 18 is affixed to spacer 24 by a layer of adhesive 44. Substrates 12 and 18 can be affixed to spacer 24 by other means than adhesive, such as heat bonding or welding. At this point one can see that a flexible plastic envelope is provided in which the conductive strips are sealed.

The surface of substrate 18 opposite from strip 38 is provided with an adhesive layer 46 which is covered by a protective plastic film 48 until it is desired to mount potentiometer 10 on a surface. When it is decided to mount potentiometer 10, protective cover 48 is removed and adhesive layer 46 is pressed against a surface so that potentiometer 10 is affixed to the surface.

In use, potentiometer 10 is arranged so that substrate 12 is contacted by a spring loaded ball assembly 50 or other suitable means which can be moved relative to potentiometer 10 along slot 26. Spring and ball assembly 50 exerts sufficient force on substrate 12 so that strip 32 is brought into electrical contact with strip 38. At this point it will be clear that the point of contact between strips 32 and 38 can be infinitely varied along slot 26, depending upon the relative position of spring and ball assembly 50 relative to potentiometer 10. The change of contact point between strips 32 and 38 will, of course, change the resistance provided by potentiometer 10 in any circuit in which it is connected.

By varying the amount of the conductive or non-conductive materials in the ink used to provide strips 32 and 38, the resistance of the strips can be varied substantially. While I have chosen to have strip 32 with a relatively low resistance and strip 38 with a relatively high resistance as compared with each other, it will be understood that, depending upon the application in which potentiometer 10 is used, that the resistance of the two strips could be identical or substantially different from each other.

Figure 1:
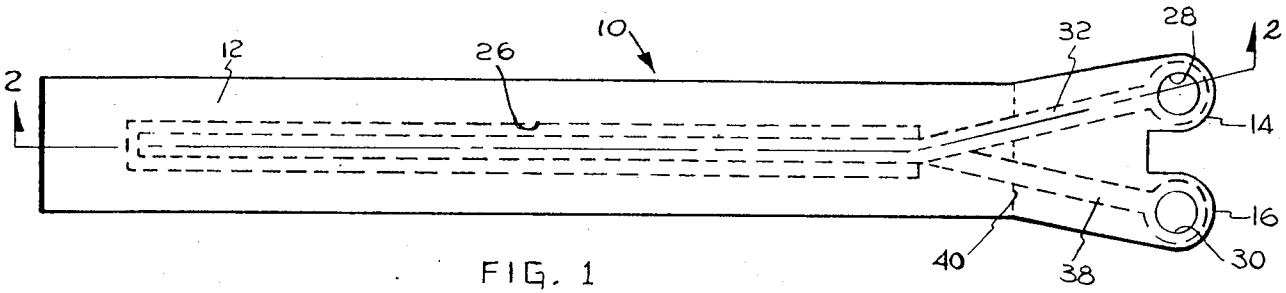
FIG. 1 is a plan view of my improved linear potentiometer.
Figure 4:
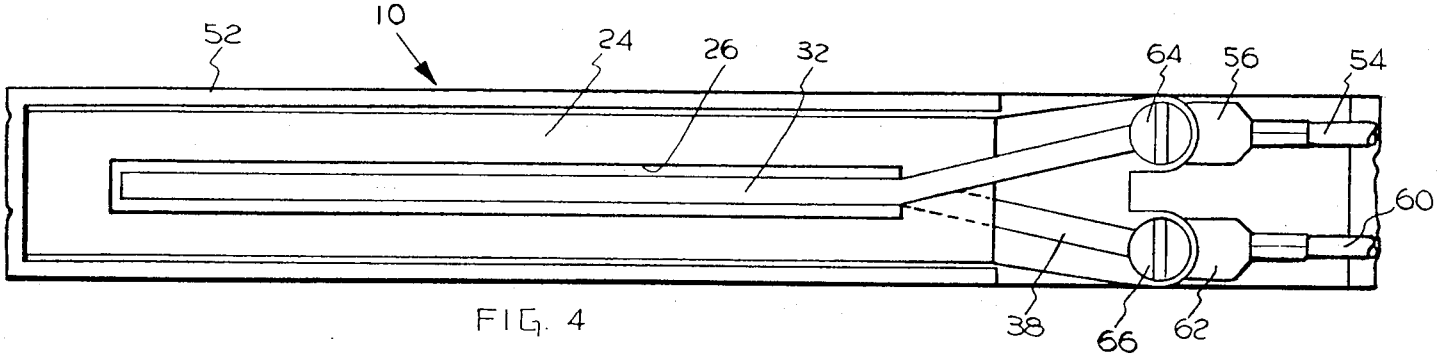
FIG. 4 is a plan view showing my improved linear potentiometer mounted on the rod of a piston and cylinder type fluid motor with the top layer of the envelope removed.
Figure 5:
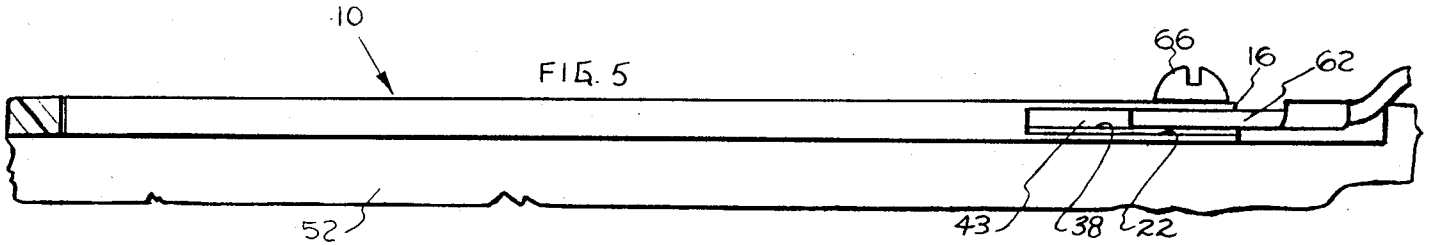
FIG. 5 is a side elevation of my improved linear potentiometer mounted as shown in FIG. 4.
Figure 6:
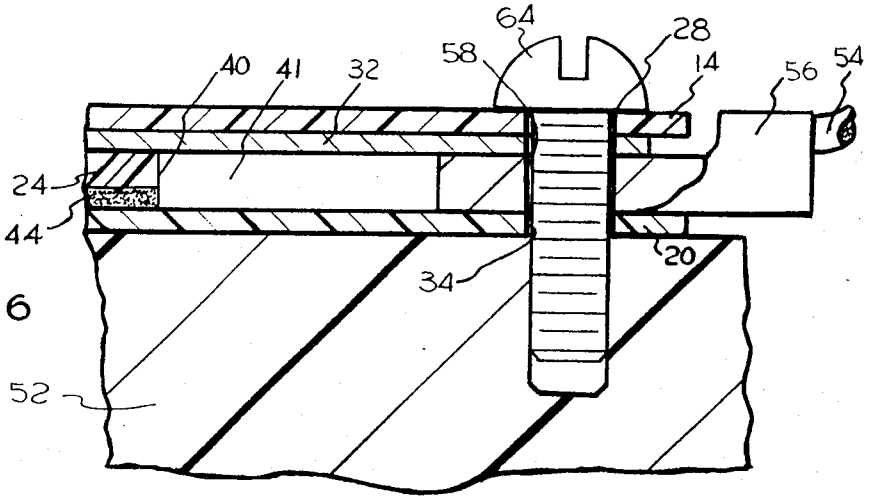
FIG. 6 is an enlarged, fragmentary longitudinal section showing the connection of a terminal to my linear potentimeter.

Referring now to FIGS. 4, 5, and 6, the mounting of potentiometer 10 on a flat surface, such as the square rod 52 of a fluid motor, and connection to an electrical circuit will be described. Protective film 48 is peeled from potentiometer 10 to expose adhesive layer 46. This adhesive layer 46 is pressed against the surface of rod 52 to which it is desired to affix potentiometer 10. In order to connect potentiometer 10 in an electrical circuit having a conductor 54 ending in a terminal 56 with an opening 58 and a conductor 60 ending in a terminal 62 which is identical to terminal 56, terminal 56 is inserted in terminal receiving slot 41 defined by tabs 14 and 20 and held in place by a screw 64 which passes through openings 28, 58, and 34 and threadably engages rod 52 to form a tight electrical connection between strip 32 and terminal 56. Similarly, terminal 62 is placed into terminal receiving slot 43 defined by tabs 16 and 22 and held in place by a screw 66 which threadably engages rod 52 to form a tight electrical connection between strip 38 and terminal 62.

Although only a single embodiment of my invention is disclosed, it is subject to various changes and modifications without departing from the spirit of the invention. Therefore, the limits of my invention should be determined from the claims construed in light of the relevant prior art.

I claim:

1. A linear potentiometer comprising a first non-conductive substrate having a first tab, a second non-conductive substrate having a second tab, a first conductive strip carried by said first substrate and running from said first tab along a portion of said first substrate, a first terminal receiving slot formed in said first tab and having a portion of the first conductive strip exposed therein, a second conductive strip carried by said second substrate and running from said second tab along a portion of said second substrate, a second terminal receiving slot formed in said second tab at a spaced location from said first terminal receiving slot and having a portion of the second conductive strip exposed therein, and a non-conductive spacer including a slot, said substrates being affixed to opposite sides of said spacer so that said strips are disposed over said slot in facing relationship to each other and said tabs are spaced laterally apart from each other and extend past one edge of said spacer, said first and second terminal receiving slots being disposed between said first and second non-conductive substrates and laterally adjacent said spacer, said portions of said first and second conductive strips extending past said one edge of said spacer and being in non-facing relationship, at least one of said substrates being flexible so that said strips can be forced into contact with each other.

2. A linear potentiometer as set forth in claim 1 wherein said strips have different electrical resistances relative to each other.

3. A linear potentiometer as set forth in claim 1 wherein said first strip has a relatively high electrical resistance and said second strip has a relatively low electrical resistance.

4. A linear potentiometer as set forth in claim 1 and including a first opening in said first tab and a second opening in said second tab, said first strip at least partially surrounding said first opening and said second strip at least partially surrounding said second opening.

5. A linear potentiometer as set forth in claim 4 wherein said strips have different electrical resistances relative to each other.

6. A linear potentiometer as set forth in claim 4 wherein said first strip has a relatively high electrical resistance and said second strip has a relatively low electrical resistance.

7. A linear potentiometer as set forth in claim 4 and including means for forcing said strips into contact with each other.

8. A linear potentiometer comprising a first non-conductive substrate having first and second tabs, a second non-conductive substrate having third and fourth tabs, a first conductive strip carried by said first substrate and running from said first tab along a portion of said first substrate, a second conductive strip carried by said second substrate and running from said fourth tab along a portion of said second substrate, and a non-conductive spacer with a slot, said substrates being affixed to opposite sides of said spacer so that said strips are disposed over said slot in facing relationship to each other, said first tab is opposite said third tab and said second tab is opposite said fourth tab, and said tabs extend past one end of said spacer to define first and second terminal receiving slots, said first and second terminal receiving slots being disposed between said first and second non-conductive substrates and laterally adjacent said spacer, said portions of said first and second conductive strips extending past said one edge of said spacer and being in non-facing relationship, at least one of said substrates being flexible so that said strips can be forced into contact with each other.

9. A linear potentiometer as set forth in claim 8 and including first and second aligned openings in said first and third tabs, respectively, and third and fourth aligned openings in said second and fourth tabs, respectively, said first strip at least partially surrounding said first opening and said second strip at least partially surrounding said fourth opening.

10. A linear potentiometer as set forth in claim 8 wherein said strips have different electrical resistances relative to each other.

11. A linear potentiometer as set forth in claim 8 wherein said first strip has a relatively high electrical resistance and said second strip has a relatively low electrical resistance.

12. A linear potentiometer as set forth in claim 8 and including means for forcing said strips into contact with each other.

13. A linear potentiometer as set forth in claim 9 wherein said strips have different electrical resistances relative to each other.

14. A linear potentiometer as set forth in claim 9 wherein said first strip has a relatively high electrical resistance and said second strip has a relatively low electrical resistance.

15. A linear potentiometer as set forth in claim 14 and including means for forcing said strips into contact with each other.

* * * * *